US011910907B2

(12) United States Patent
Zhong

(10) Patent No.: US 11,910,907 B2
(45) Date of Patent: Feb. 27, 2024

(54) COSMETIC JAR HAVING REPLACEABLE INNER CUP

(71) Applicant: COPOLYMER & COSMETICS TECHOLOGY (KUNSHAN) CO. , LTD., Kunshan (CN)

(72) Inventor: Hua Zhong, Kunshan (CN)

(73) Assignee: COPOLYMER & COSMETICS TECHOLOGY (KUNSHAN) CO., LTD., Kunshan (CN)

( * ) Notice: Subject to any disclaimer, the term of this patent is extended or adjusted under 35 U.S.C. 154(b) by 233 days.

(21) Appl. No.: 17/635,707

(22) PCT Filed: Jul. 27, 2020

(86) PCT No.: PCT/CN2020/104869
§ 371 (c)(1),
(2) Date: Feb. 16, 2022

(87) PCT Pub. No.: WO2021/031798
PCT Pub. Date: Feb. 25, 2021

(65) Prior Publication Data

US 2022/0287436 A1 Sep. 15, 2022

(30) Foreign Application Priority Data

Aug. 16, 2019 (CN) ..... 201921329857.2

(51) Int. Cl.
*A45D 40/00* (2006.01)
*A45D 33/00* (2006.01)
*A45D 34/00* (2006.01)

(52) U.S. Cl.
CPC ..... *A45D 40/0068* (2013.01); *A45D 33/00* (2013.01); *A45D 34/00* (2013.01); *A45D 2034/005* (2013.01)

(58) Field of Classification Search
CPC .... A45D 40/0068; A45D 33/00; A45D 34/00; A45D 2034/005
(Continued)

(56) References Cited

U.S. PATENT DOCUMENTS 3,688,942 A * 9/1972 Mitchell ..... B65D 21/0219 220/784
3,946,893 A * 3/1976 Bowersmith ..... A47J 27/10 220/756
5,348,181 A * 9/1994 Smith ..... B65D 43/0212 220/793

FOREIGN PATENT DOCUMENTS

CN 210747807 U 6/2020
EP 0661012 A1 7/1995
(Continued)

*Primary Examiner* — Valentin Neacsu
*Assistant Examiner* — Eric C Baldrighi
(74) *Attorney, Agent, or Firm* — Bayramoglu Law Offices LLC

(57) ABSTRACT

A cosmetic jar having a replaceable inner cup is provided. Two symmetric tabs are provided at an upper opening of an inner cup, the tabs each are provided with a tab clamping portion, accommodation regions recessed inward in a radial direction and shaped as a notch are symmetrically formed on an external thread of the outer jar, and an outer jar clamping portion is respectively provided at the accommodation regions. When the tabs are bent downward, the tab clamping portion can be clamped in the outer jar clamping portion to connect the inner cup into the outer jar. After materials in the original inner cup is used up, the empty inner cup can be taken out by releasing the connection between the tab clamping portion and the outer jar clamping portion, and a replacement inner cup is placed and fastened in the outer jar.

9 Claims, 10 Drawing Sheets

(58) Field of Classification Search
USPC ..... 220/23.89
See application file for complete search history.

(56) References Cited

FOREIGN PATENT DOCUMENTS

| | | | | | |
|---|---|---|---|---|---|
| JP | H10129724 | A | | 5/1998 | |
| JP | 2590560 | Y2 | * | 2/1999 | ..... B65D 77/06 |
| JP | 2010195484 | A | * | 9/2010 | |
| JP | 2011157083 | A | * | 8/2011 | |
| JP | 2016222287 | A | | 12/2016 | |
| JP | 2020050425 | A | * | 4/2020 | ..... G03F 7/70741 |
| KR | 20110002483 | U | * | 3/2011 | ..... A45D 33/04 |
| KR | 20140115535 | A | * | 10/2014 | ..... B65D 53/02 |
| KR | 101850044 | B1 | * | 4/2018 | ..... A45D 34/00 |
| WO | WO-2015026128 | A1 | * | 2/2015 | ..... A45D 33/006 |
| WO | WO-2016194473 | A1 | * | 12/2016 | ..... A45D 33/00 |
| WO | WO-2022259926 | A1 | * | 12/2022 | ..... B65D 77/04 |

* cited by examiner

COSMETIC JAR HAVING REPLACEABLE INNER CUP

CROSS REFERENCE TO THE RELATED APPLICATIONS

This application is the national phase entry of International Application No. PCT/CN2020/104869, filed on Jul. 27, 2020, which is based upon and claims priority to Chinese Patent Application No. 201921329857.2, filed on Aug. 16, 2019, the entire contents of which are incorporated herein by reference.

TECHNICAL FIELD

The present invention relates to cosmetic containers, and more particularly, relates to a cosmetic jar having a replaceable inner cup.

BACKGROUND

With the economic development and the improvement of living standards, skin cares and cosmetics have been indispensable to people's life, and containers for filling these skin cares and cosmetics are also becoming more diverse. For existing common cosmetic jars, an outer jar and an inner cup are often formed integrally or fixed firmly together. When the materials in the inner cup are used up, the whole cosmetic jar is abandoned, which causes a serious resource waste. In view of the above technical problem, it has been suggested that the outer jar and the inner cup are designed as a detachable structure, and after the materials in the inner cup are used up, the inner cup can be taken out and directly replaced by a new one filled with the materials. In this way, the outer jar can be reused to relieve the resource waste. However, in the prior art, the outer jar and the inner cup in most cases are threadedly connected through the matched screw threads arranged on the inner wall of the outer jar and the outer wall of the inner cup to implement the detachable and replaceable functions. However, in case of the threaded connection when the inner cup is taken out, the outer jar and the inner cup are respectively held by two hands, and the inner cup is screwed out of the outer jar, which makes the operation inconvenient, and the materials is easily contaminated by the hand screwing the inner cup. In addition, the threaded connection further leads to looseness between the inner cup and the outer jar due to infirm screwing in use.

SUMMARY

The present invention provides a cosmetic jar having a replaceable inner cup to solve the above technical problems. With the replaceable inner cup and the reusable jar body, the present invention meets the present economic and environment-friendly requirements.

The present invention uses the following technical solutions:

A cosmetic jar having a replaceable inner cup includes an outer jar, the inner cup sleeved in the outer jar, and a lid covering the outer jar and the inner cup, where two sides, symmetric with respect to a central axis of the inner cup, of an upper opening of the inner cup extend outward to form tabs capable of being bent downward; the two tabs each are provided with a tab clamping portion; an external thread is circumferentially provided on an outer circumferential sidewall of the outer jar and adjacent to an opening of the outer jar; two sides of the external thread symmetric with respect to a central axis of the outer jar are respectively recessed inward in a radial direction to form accommodation regions matched with the tabs in shape; an outer jar clamping portion is respectively provided at the two accommodation regions on the outer jar; and when the tabs are bent downward, the tab clamping portion is clamped in the outer jar clamping portion to connect the inner cup into the outer jar.

As a further technical solution:

The tabs each may be of a strip sheet structure; a junction where the strip sheet structure may be connected to an upper end of an outer circumferential sidewall of the inner cup may have a tapered thickness to form a bending portion; and a tail end of the strip sheet structure may be tilted outward in the radial direction to form a curved gripping portion As a further technical solution:

The tab clamping portion may include a tab protrusion fastener provided on a side of each of the tabs facing toward the circumferential sidewall of the inner cup; the outer jar clamping portion may include an outer jar through hole formed at each of the accommodation regions on the circumferential sidewall of the outer jar; and by bending the tabs downward, the tab protrusion fastener may be clamped in the outer jar through hole to position and connect the outer jar and the inner cup.

The tab protrusion fastener may include an upright protruding from a surface of each of the tabs; an arc surface for sliding the upright into the outer jar through hole conveniently may be formed on one side of an end portion of the upright; the other side, opposite to the arc surface, of the end portion of the upright may be expanded to form a stop portion capable of stopping the upright at the outer jar through hole; and the upright of the tab protrusion fastener may be inserted into the outer jar through hole via the arc surface, and stopped at the outer jar through hole by the stop portion.

As a further technical solution:

The tab clamping portion may include a convex stepwise structure provided on each of the tabs and facing toward the outer circumferential sidewall of the inner cup; the outer jar clamping portion may include a concave stepwise structure provided at each of the accommodation regions on the outer circumferential sidewall of the outer jar and matched with the convex stepwise structure; and by bending the tabs downward, the convex stepwise structure and the concave stepwise structure may be in an interference fit to position and connect the outer jar and the inner cup.

The convex stepwise structure may be a convex one-stage step structure on a surface of each of the tabs; the concave stepwise structure may be a concave one-stage step structure on a surface of the outer circumferential sidewall of the outer jar; and a step surface of the convex one-stage step structure and a step surface of the concave one-stage step structure may be in the interference fit.

As a further technical solution:

The tab clamping portion may include a tab through hole on each of the tabs; the outer jar clamping portion may include an outer jar convex rib at each of the accommodation regions on the outer circumferential sidewall of the outer jar; and by bending the tabs downward, the outer jar convex rib may be clamped in the tab through hole to position and connect the outer jar and the inner cup.

The outer jar convex rib may include a columnar structure protruding from a surface of the outer circumferential sidewall of the outer jar; an arc surface for sliding the columnar structure into the tab through hole conveniently may be formed on one side of an end portion of the columnar structure; the other side, opposite to the arc surface, of the end portion of the columnar structure may be expanded to form a stop surface capable of stopping the columnar structure at the tab through hole; and the columnar structure of the outer jar convex rib may be inserted into the tab through hole via the arc surface, and stopped at the tab through hole by the stop surface.

As a further technical solution:

An internal thread may be provided on an inner circumferential sidewall of the lid, and the internal thread may be matched with and threadedly connected to the external thread of the outer jar; and both a highest point of each of the tabs and a highest point of the outer circumferential sidewall at each of the accommodation regions of the outer jar may not exceed a highest point of the external thread on the outer jar.

The present invention has the following beneficial effects: Two symmetric tabs are provided at an upper opening of an inner cup, the tabs each are provided with a tab clamping portion, accommodation regions recessed inward in a radial direction and shaped as a notch are symmetrically formed on an external thread of the outer jar, an outer jar clamping portion is respectively provided at the accommodation regions, and when the tabs are bent downward, the tab clamping portion can be clamped in the outer jar clamping portion to connect the inner cup into the outer jar. The outer jar clamping portion may employ various forms such as a combination of a protrusion fastener and a through hole, and a combination of concave and convex stepwise structures. After the material in the original inner cup is used up, the empty inner cup can be taken out by releasing the connection between the tab clamping portion and the outer jar clamping portion, and a replacement inner cup is placed and fastened in the outer jar. The replacement of the inner cup can be accomplished by a single hand without contacting the opening of the inner cup and contaminating the material. Therefore, the cosmetic jar achieves the simple structure, convenience in replacement, and reuse of the outer jar, thereby being economical and environment-friendly.

IN THE FIGURES

Figure 1:
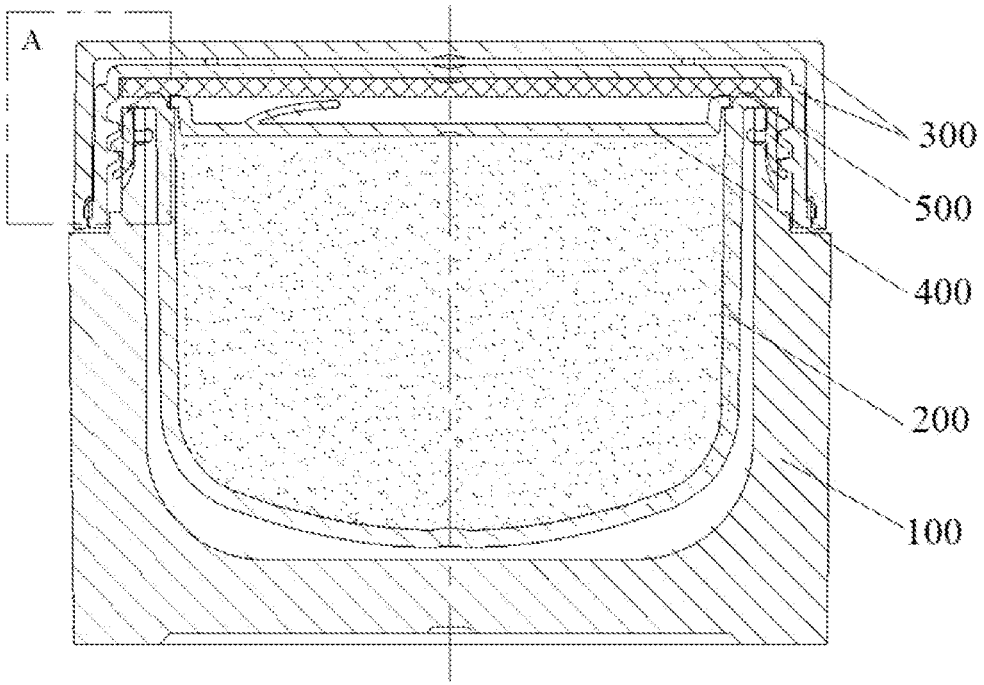
FIG. 1 illustrates an overall sectional view of a cosmetic jar in a closed state in a first form according to the present invention.
Figure 2:
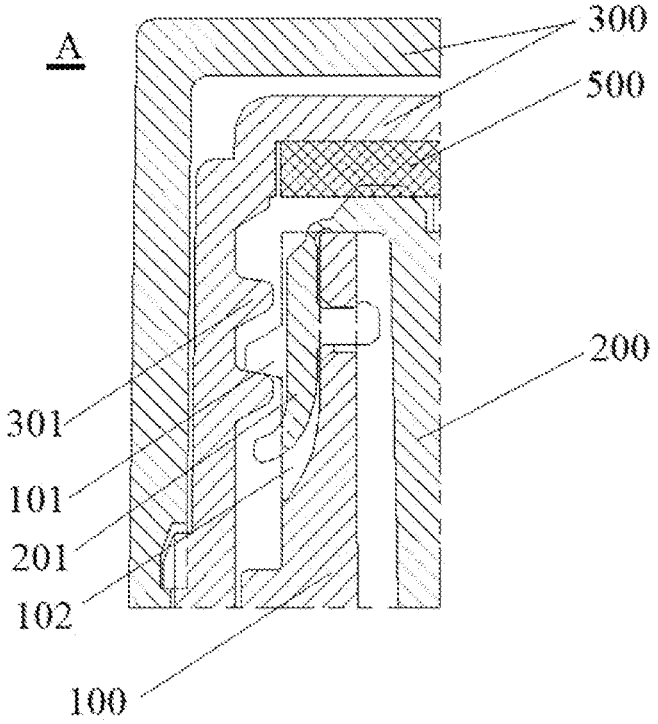
FIG. 2 illustrates an enlarged view of A in FIG. 1.
Figure 3:
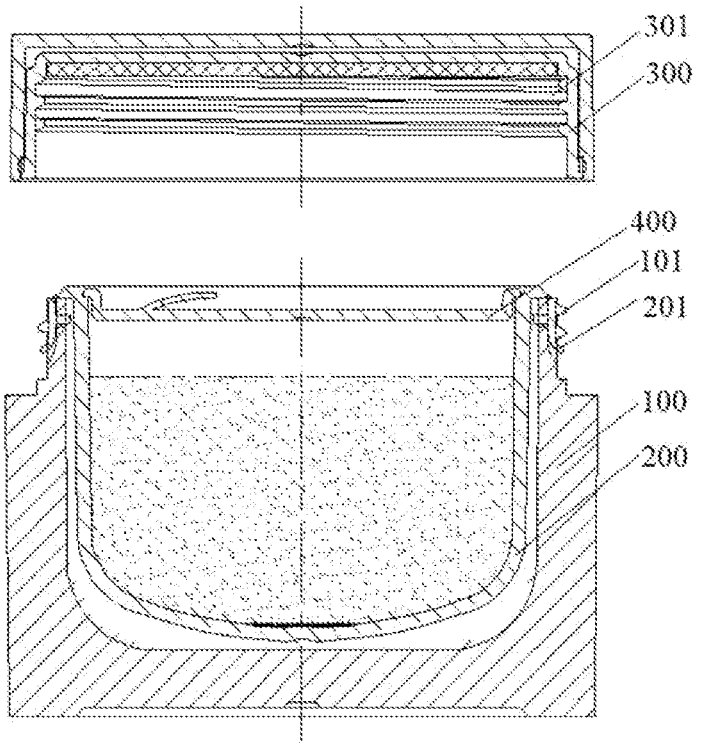
FIG. 3 illustrates a sectional view of an opened state of the form in FIG. 1.
Figure 4:
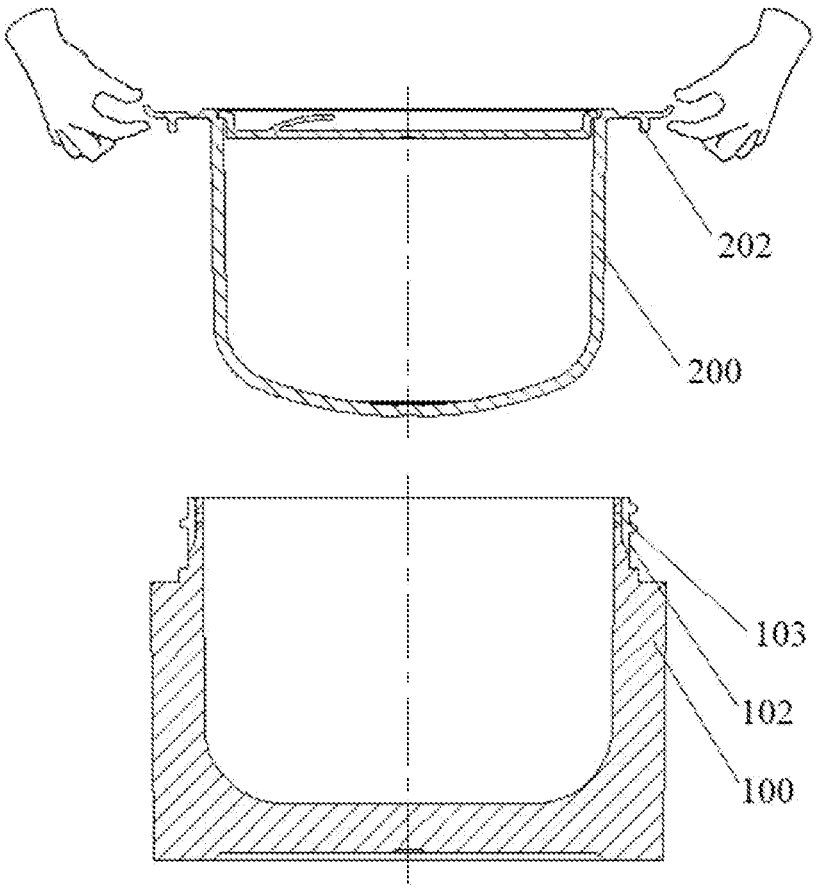
FIG. 4 illustrates a sectional view in which an inner cup is taken out of an outer jar in the form in FIG. 1.

100 outer jar;
101 external thread;
102 accommodation region;
103 outer jar clamping portion;
103*a* outer jar through hole;
103*b* concave stepwise structure;
103*c* outer jar convex rib; 103*c*-1 upright; 103*c*-2 arc surface; 103*c*-3 stop surface;
200 inner cup;
201 tab; 201-1 bending portion; 201-2 gripping portion;
202 tab clamping portion;
202*a* tab protrusion fastener; 202*a*-1 upright; 202*a*-2 arc surface; 202*a*-3 stop portion;
202*b* convex stepwise structure;
202*c* tab through hole;
300 lid; 301 internal thread;
400 coversheet; and
500 pad.

DETAILED DESCRIPTION OF THE EMBODIMENTS

In order to understand the technical means of the present invention more clearly and implement the technical means according to contents in the specification, specific implementations of the present invention will be further described below in detail with reference to the accompanying drawings and embodiments. The embodiments described below are intended to illustrate the present invention, rather than limit the scope of the present invention.

The cosmetic jar having a replaceable inner cup in the present invention will be described below in detail. The cosmetic jar mainly includes an outer jar 100, an inner cup 200 and a lid 300. The inner cup 200 is sleeved and connected in the outer jar. The lid 300 is threadedly connected to the outer jar and covers the outer jar and the inner cup. The lid 300 may be an integral lid, and may also be a lid having a detachable structure formed by an outer lid and an inner lid through a buckling structure. The buckling structure is the conventional buckling structure, and will not be repeated in the specific embodiment. In the following specific embodiments, the lid having the detachable structure is used. For the lid having such a structure, an internal thread 301 is provided on an inner circumferential sidewall of the inner lid, an external thread 101 is circumferentially provided on an outer circumferential sidewall of the outer jar 100 and adjacent to an opening of the outer jar, and the external thread and the internal thread are matched with and threadedly connected to cover the lid 300 on the outer jar 100 and the inner cup 200. The above structure is the conventional technical solution in the technical field, and will not be repeated in the following specific embodiments. According to the technical solution, the inner cup is filled with a material which may be the common cosmetic such as a facial cream. In order not to contaminate the material in the inner cup, a coversheet 400 may be provided at the opening of the inner cup. Specifically, a one-stage step structure is provided on the circumferential sidewall at the opening of the inner cup, and the coversheet is provided at the one-stage step structure. In addition, a pad 500 is provided on an inner top surface of the lid 300. The pad is fixed on an inner surface of the lid and at a top edge of the opening of the inner cup to implement the sealing between the inside of the inner cup and the lid. The above structure is the conventional design in the art, and will not be repeated herein.

The structure in which the inner cup 200 is sleeved and connected in the outer jar 100 is as follows: two sides, symmetric with respect to a central axis of the inner cup, of an upper opening of the inner cup 200 extend outward to form tabs 201 capable of being bent downward; the two tabs each are provided with a tab clamping portion 202; two sides of the external thread symmetric with respect to a central axis of the outer jar are respectively recessed inward in a radial direction to form accommodation regions 102 matched with the tabs in shape; an outer jar clamping portion 103 is respectively provided at the two accommodation regions on the outer jar; and when the tabs are bent downward, the tab clamping portion 202 can be clamped in the outer jar clamping portion 103 to connect the inner cup into the outer jar. In the above structure, the tabs 201 each have a strip sheet structure; a junction where the strip sheet structure is connected to an upper end of the outer circumferential sidewall of the inner cup has a tapered thickness to form a bending portion 201-1; and a tail end of the strip sheet structure is tilted outward in the radial direction to form a curved gripping portion 201-2. In the above structure, the accommodation regions 102 are matched with the tabs in shape, and specifically matched with the structures of the tabs. The accommodation regions each are recessed in the radial direction from top to bottom from the opening of the outer jar, with a tail end extending outward gradually in the vertical direction to form an arc shape matched with the gripping portion of each of the tabs. The tabs can be rightly accommodated in the accommodation regions without affecting the normal use of the lid 300.

The tab clamping portion 202 and the outer jar clamping portion 103 may be matched in various forms. The following descriptions are made to three forms with reference to the accompanying drawings. However, the technical solutions of the present invention are not limited to the following three forms.

Figure 5:
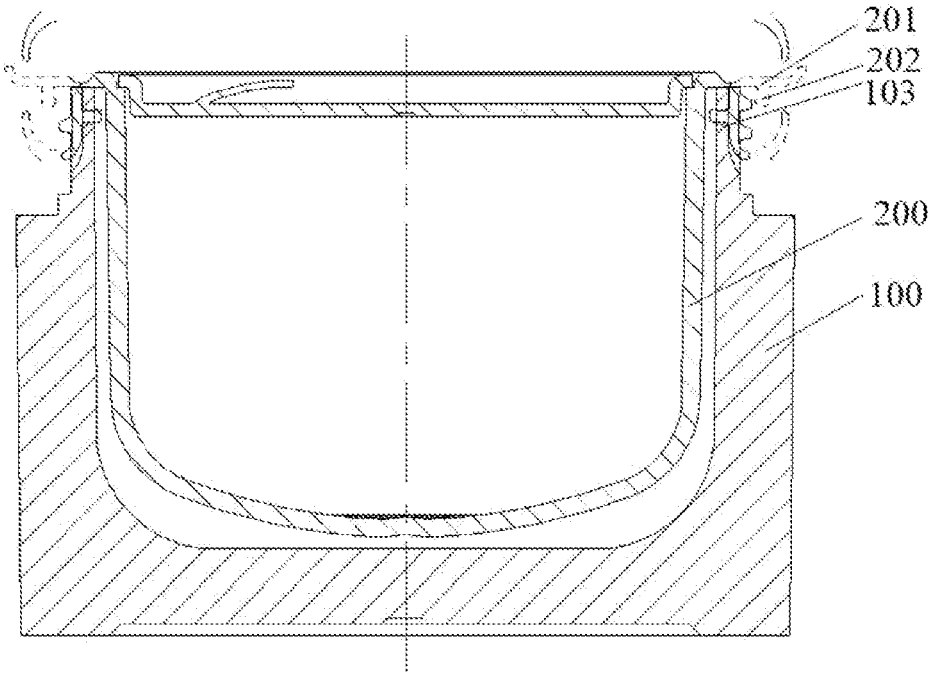
FIG. 5 illustrates a sectional view of a combination of an inner cup and an outer jar in a first form according to the present invention, a direction indicated by an arrow being a direction in which a tab moves.
Figure 6:
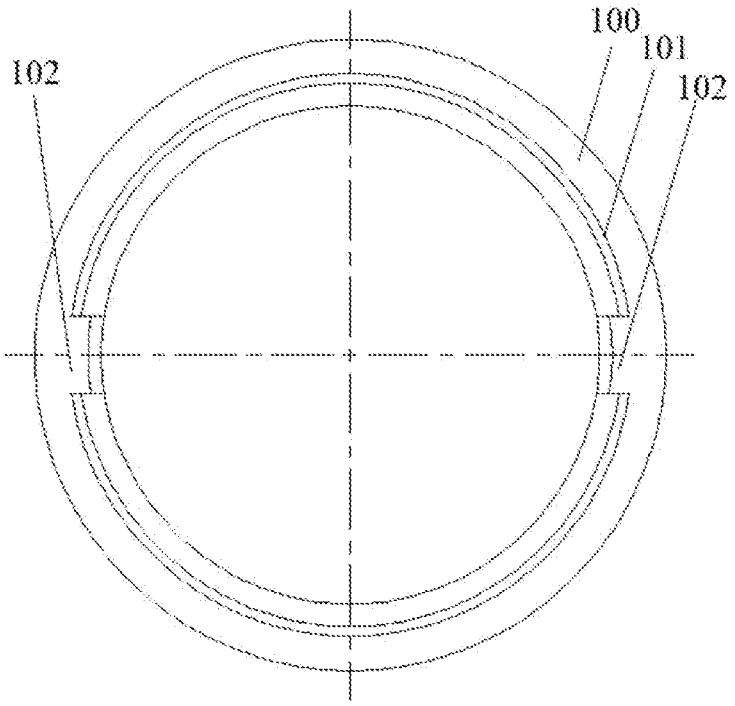
FIG. 6 illustrates a top view of an outer jar in a first form according to the present invention.
Figure 7:
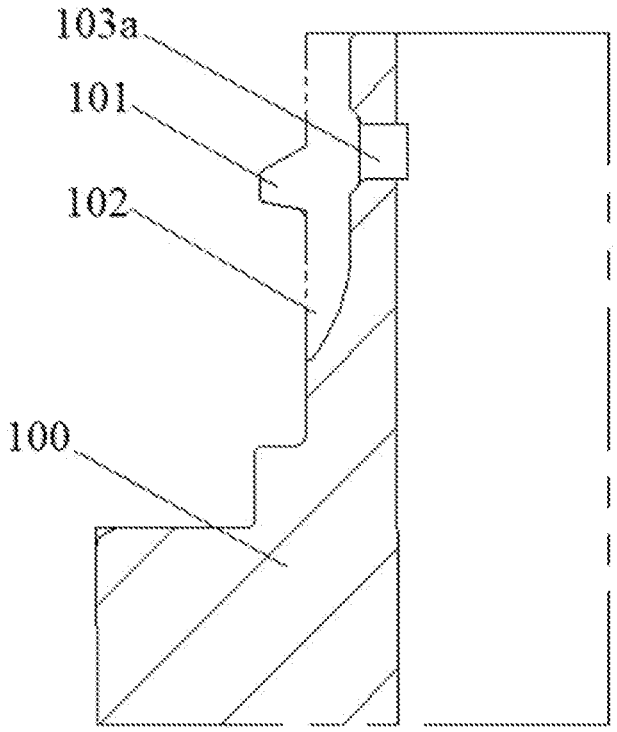
FIG. 7 illustrates a structural view of an outer jar clamping portion on an outer jar in FIG. 5.
Figure 8:
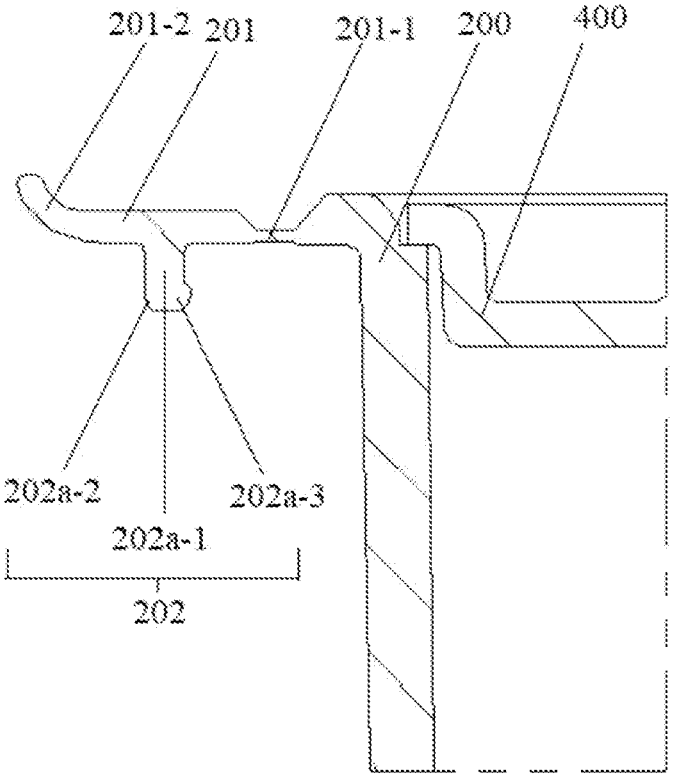
FIG. 8 illustrates a structural view of a tab clamping portion on a tab in FIG. 5.
Figure 9:
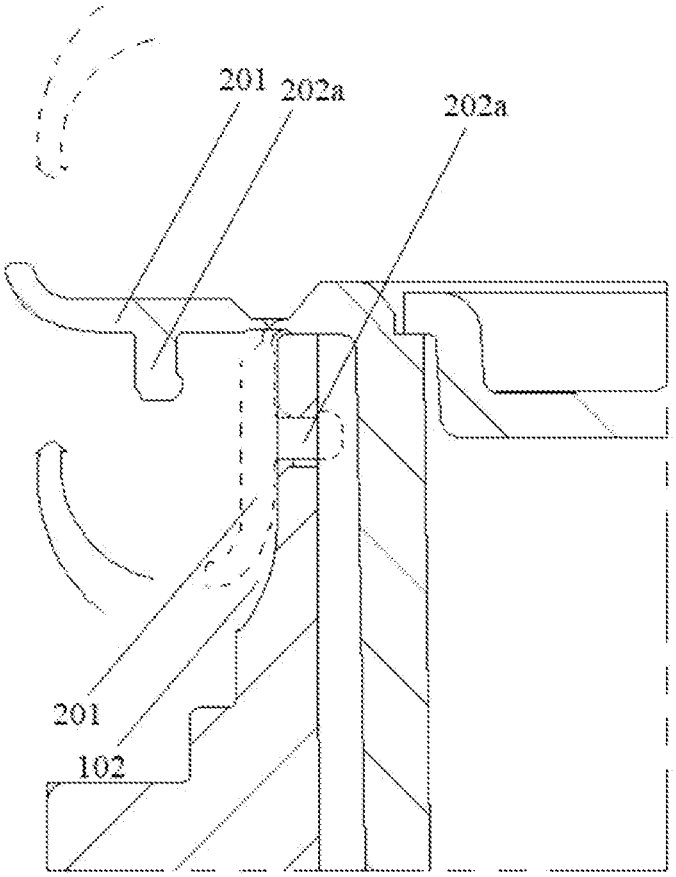
FIG. 9 illustrates a structural view of a combination of an outer jar clamping portion and a tab clamping portion in FIG. 5, a direction indicated by an arrow being a direction in which a tab moves.

First form: referring to FIG. 5 to FIG. 9, the tab clamping portion 202 includes a tab protrusion fastener 202*a* provided on a side of each of the tabs facing toward the circumferential sidewall of the inner cup; the outer jar clamping portion 103 includes an outer jar through hole 103*a* formed at each of the accommodation regions on the circumferential sidewall of the outer jar; and by bending the tabs downward, the tab protrusion fastener is clamped in the outer jar through hole to position and connect the outer jar and the inner cup. The tab protrusion fastener 202*a* includes an upright 202*a*-1 protruding from a surface of each of the tabs; an arc surface 202*a*-2 for sliding the upright into the outer jar through hole conveniently is formed on one side of an end portion of the upright; and the other side, opposite to the arc surface, of the end portion of the upright is expanded to form a stop portion 202*a*-3 capable of stopping the upright at the outer jar through hole. Most preferably, when the tabs are closed, the arc surface is located below the end portion of the upright, and the stop portion is located above the end portion of the upright. The upright of the tab protrusion fastener is inserted into the outer jar through hole via the arc surface, and stopped at the outer jar through hole by the stop portion.

Figure 10:
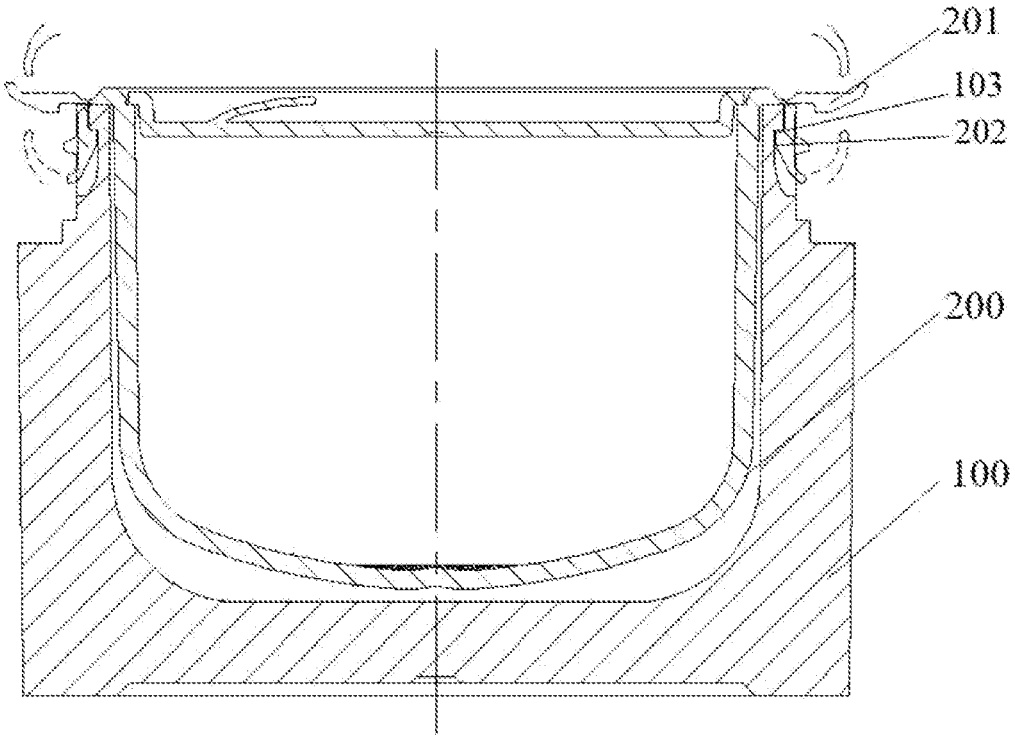
FIG. 10 illustrates a sectional view of a combination of an inner cup and an outer jar in a second form according to the present invention, a direction indicated by an arrow being a direction in which a tab moves.
Figure 11:
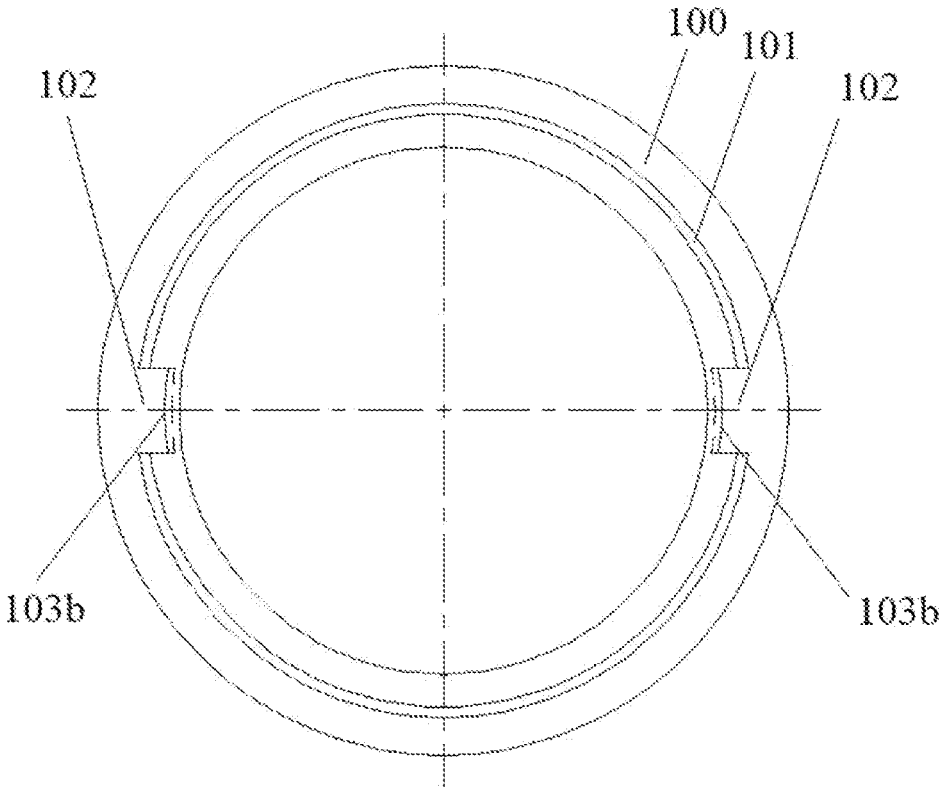
FIG. 11 illustrates a top view of an outer jar in a second form according to the present invention.
Figure 12:
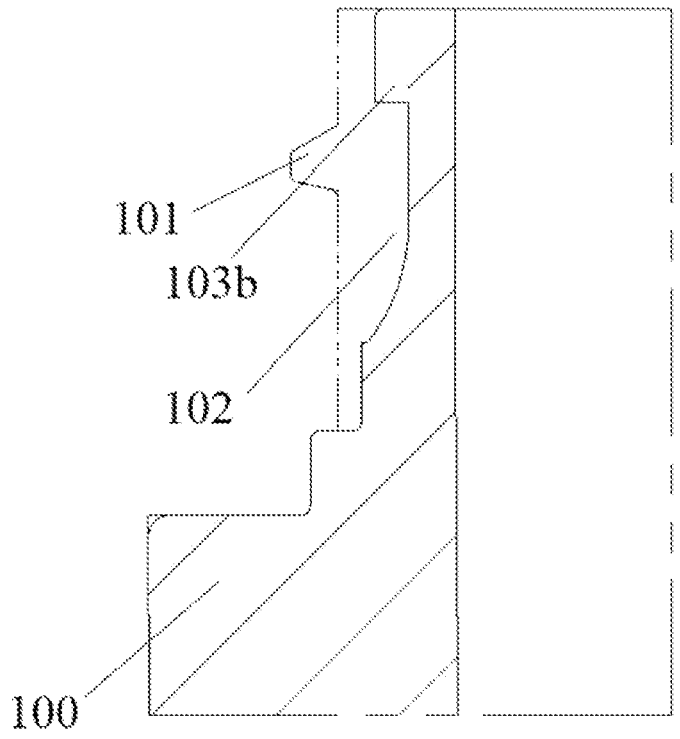
FIG. 12 illustrates a structural view of an outer jar clamping portion on an outer jar in FIG. 10.
Figure 13:
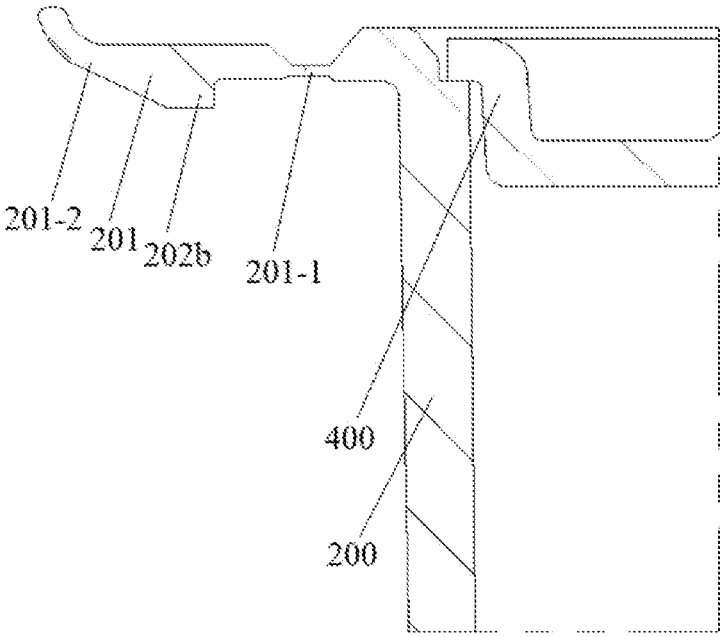
FIG. 13 illustrates a structural view of a tab clamping portion on a tab in FIG. 10.
Figure 14:
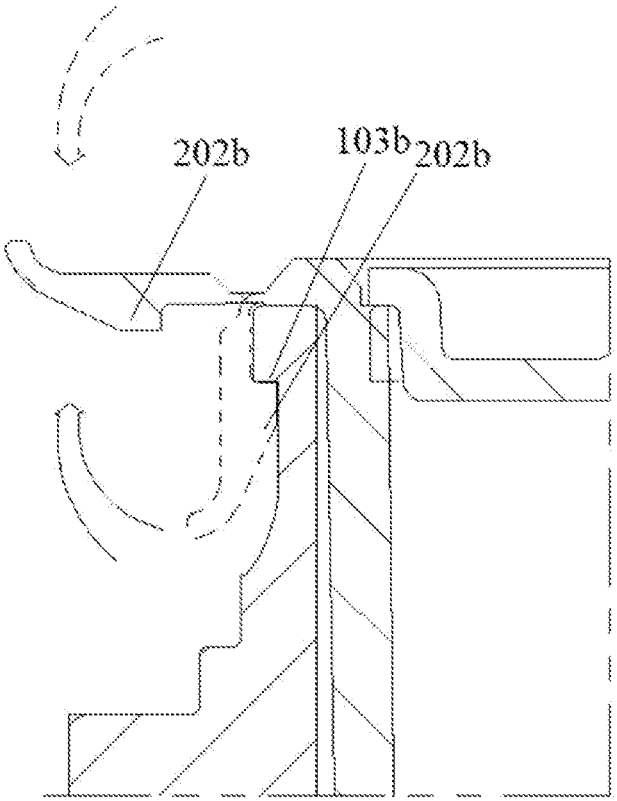
FIG. 14 illustrates a structural view of a combination of an outer jar clamping portion and a tab clamping portion in FIG. 10, a direction indicated by an arrow being a direction in which a tab moves.

Second form: referring to FIG. 10 to FIG. 14, the tab clamping portion 202 includes a convex stepwise structure 202*b* provided on each of the tabs and facing toward the outer circumferential sidewall of the inner cup; the outer jar clamping portion 103 includes a concave stepwise structure 103*b* provided at each of the accommodation regions on the outer circumferential sidewall of the outer jar and matched with the convex stepwise structure; and by bending the tabs downward, the convex stepwise structure and the concave stepwise structure are in an interference fit to position and connect the outer jar and the inner cup. The convex stepwise structure 202*b* is a convex one-stage step structure on the surface of each of the tabs; the concave stepwise structure 103*b* is a concave one-stage step structure on a surface of the outer circumferential sidewall of the outer jar; and a step surface of the convex one-stage step structure and a step surface of the concave one-stage step structure are in the interference fit.

Figure 15:
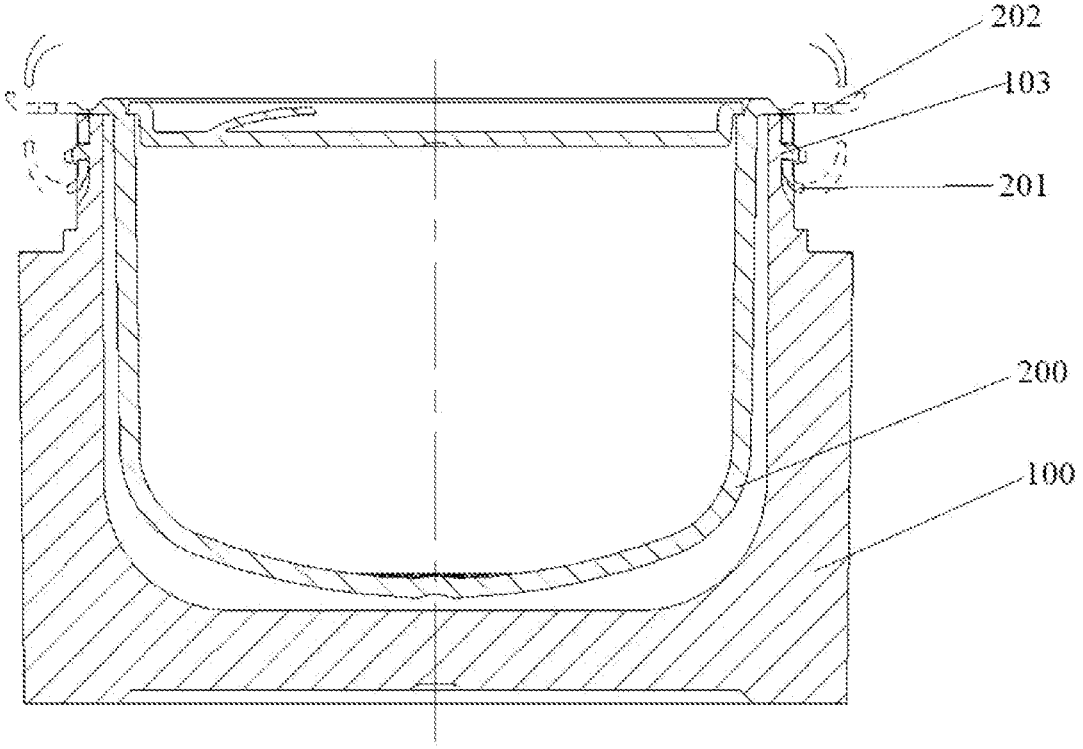
FIG. 15 illustrates a sectional view of a combination of an inner cup and an outer jar in a third form according to the present invention, a direction indicated by an arrow being a direction in which a tab moves.
Figure 16:
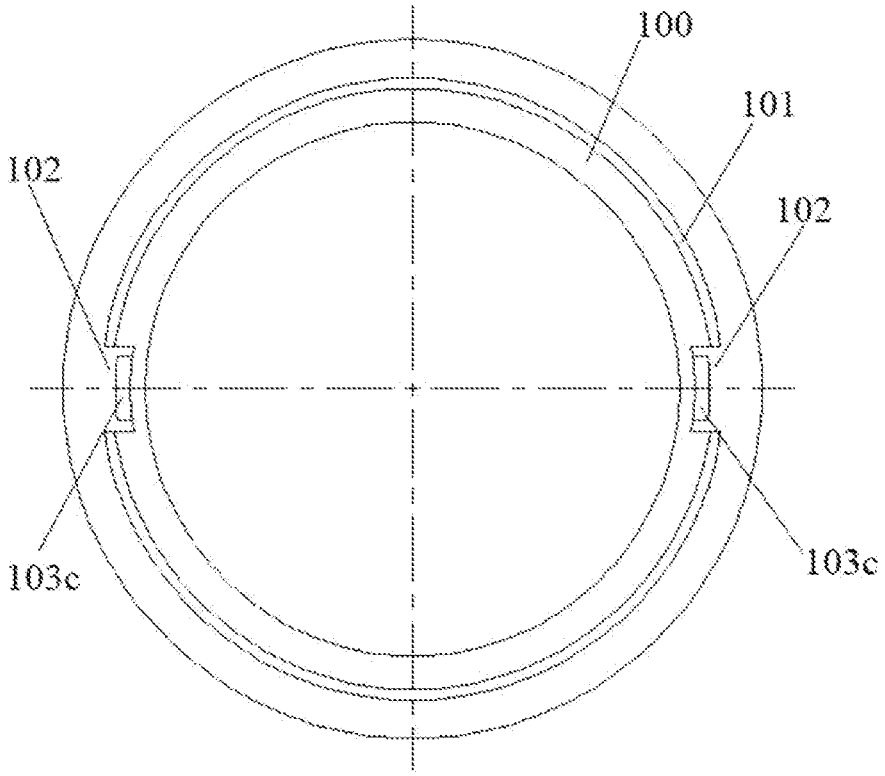
FIG. 16 illustrates a top view of an outer jar in a third form according to the present invention.
Figure 17:
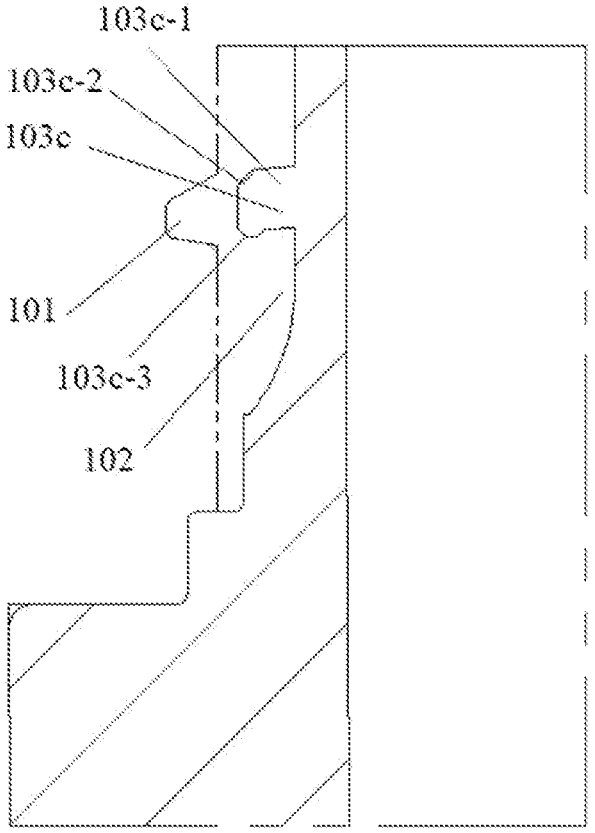
FIG. 17 illustrates a structural view of an outer jar clamping portion on an outer jar in FIG. 15.
Figure 18:
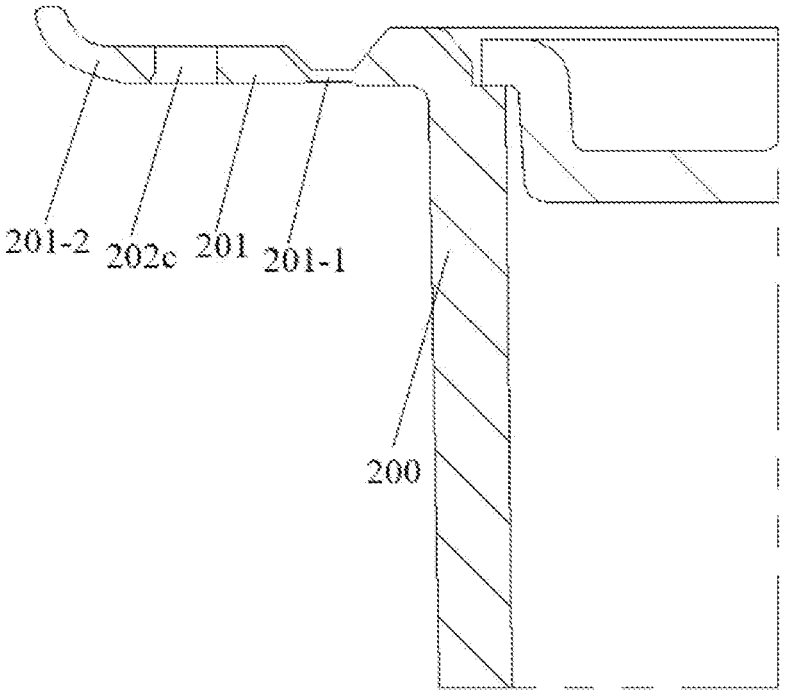
FIG. 18 illustrates a structural view of a tab clamping portion on a tab in FIG. 15.
Figure 19:
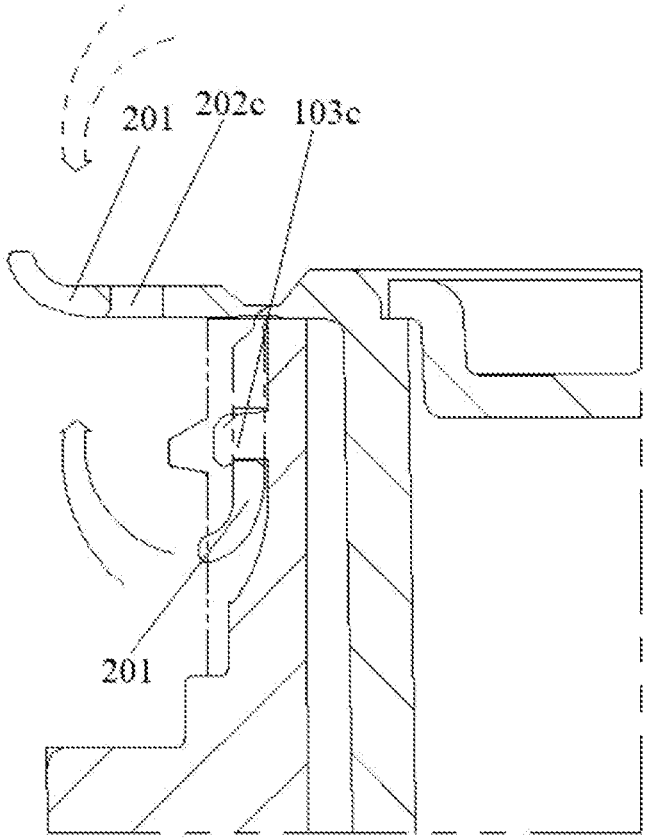
FIG. 19 illustrates a structural view of a combination of an outer jar clamping portion and a tab clamping portion in FIG. 15, a direction indicated by an arrow being a direction in which a tab moves.

Third form: referring to FIG. 15 to FIG. 19, the tab clamping portion 202 includes a tab through hole 202*c* on each of the tabs; the outer jar clamping portion 103 includes an outer jar convex rib 103*c* at each of the accommodation regions on the outer circumferential sidewall of the outer jar; and by bending the tabs downward, the outer jar convex rib is clamped in the tab through hole to position and connect the outer jar and the inner cup. The outer jar convex rib 103*c* includes a columnar structure 103*c*-1 protruding from a surface of the outer circumferential sidewall of the outer jar; an arc surface 103*c*-2 for sliding the columnar structure into the tab through hole conveniently is formed on one side of an end portion of the columnar structure; and the other side, opposite to the arc surface, of the end portion of the columnar structure is expanded to form a stop surface 103*c*-3 capable of stopping the columnar structure at the tab through hole. Most preferably, the arc surface is located above the end portion of the columnar structure, and the stop surface is located below the end portion of the columnar structure. The columnar structure of the outer jar convex rib is inserted into the tab through hole via the arc surface, and stopped at the tab through hole by the stop surface.

In the above three specific structures, both a highest point of each of the tabs and a highest point of the outer circumferential sidewall at each of the accommodation regions of the outer jar do not exceed a highest point of the external thread on the outer jar, so as to ensure the threaded connection between the lid and the external thread.

According to the cosmetic jar, two symmetric tabs are provided at an upper opening of an inner cup, the tabs each are provided with a tab clamping portion, accommodation regions recessed inward in a radial direction and shaped as a notch are symmetrically formed on an external thread of the outer jar, an outer jar clamping portion is respectively provided at the accommodation regions, and when the tabs are bent downward, the tab clamping portion can be clamped in the outer jar clamping portion to connect the inner cup into the outer jar. The outer jar clamping portion may employ various forms such as a combination of a protrusion fastener and a through hole, and a combination of concave and convex stepwise structures. After the material in the original inner cup is used up, the empty inner cup can be taken out by releasing the connection between the tab clamping portion and the outer jar clamping portion, and a replacement inner cup is placed and fastened in the outer jar. The replacement of the inner cup can be accomplished by a single hand without contacting the opening of the inner cup and contaminating the material. Therefore, the cosmetic jar achieves the simple structure, convenience in replacement, and reuse of the outer jar, thereby being economical and environment-friendly.

The above descriptions are merely preferred implementations of the present invention, rather than limitations to the present invention. It should be noted that a person of ordinary skill in the art may further make improvements and modifications without departing from the technical principles of the present invention, and these improvements and modifications should be deemed as falling within the protection scope of the present invention.

What is claimed is:

1. A cosmetic jar having a replaceable inner cup, comprising an outer jar, an inner cup sleeved in the outer jar, and a lid covering the outer jar and the inner cup, wherein two sides, symmetric with respect to a central axis of the inner cup, of an upper opening of the inner cup extend outward to form two tabs, wherein the two tabs are configured to be bent downward;

the two tabs each are provided with a tab clamping portion;

an external thread is circumferentially provided on an outer circumferential sidewall of the outer jar and the external thread is adjacent to an opening of the outer jar;

two sides of the external thread symmetric with respect to a central axis of the outer jar are respectively recessed inward in a radial direction to form two accommodation regions matched with the two tabs in shape;

an outer jar clamping portion is respectively provided at the two accommodation regions on the outer jar; and when the two tabs are bent downward, the tab clamping portion is clamped in the outer jar clamping portion to connect the inner cup into the outer jar.

2. The cosmetic jar having the replaceable inner cup according to claim 1, wherein the two tabs each have a strip sheet structure;

a junction has a tapered thickness to form a bending portion, wherein the strip sheet structure is connected to an upper end of an outer circumferential sidewall of the inner cup at the junction; and a tail end of the strip sheet structure is tilted outward in the radial direction to form a curved gripping portion.

3. The cosmetic jar having the replaceable inner cup according to claim 2, wherein the tab clamping portion comprises a tab protrusion fastener provided on a side of each of the two tabs, wherein the side of each of the two tabs faces toward the outer circumferential sidewall of the inner cup;

the outer jar clamping portion comprises an outer jar through hole formed at each of the two accommodation regions on the outer circumferential sidewall of the outer jar; and by bending the two tabs downward, the tab protrusion fastener is clamped in the outer jar through hole to position and connect the outer jar and the inner cup.

4. The cosmetic jar having the replaceable inner cup according to claim 3, wherein the tab protrusion fastener comprises an upright protruding from a surface of each of the two tabs;

an arc surface for sliding the upright into the outer jar through hole conveniently is formed on a first side of an end portion of the upright;

a second side, opposite to the arc surface, of the end portion of the upright is expanded to form a stop portion, wherein the second side of the end portion of the upright is opposite to the arc surface, and the stop portion is configured to stop the upright at the outer jar through hole; and the upright of the tab protrusion fastener is inserted into the outer jar through hole via the arc surface, and the upright of the tab protrusion fastener is stopped at the outer jar through hole by the stop portion.

5. The cosmetic jar having the replaceable inner cup according to claim 2, wherein the tab clamping portion comprises a convex stepwise structure, wherein the convex stepwise structure is provided on each of the two tabs and the convex stepwise structure faces toward the outer circumferential sidewall of the inner cup;

the outer jar clamping portion comprises a concave stepwise structure, wherein the concave stepwise structure is provided at each of the two accommodation regions on the outer circumferential sidewall of the outer jar and the concave stepwise structure is matched with the convex stepwise structure; and by bending the two tabs downward, the convex stepwise structure and the concave stepwise structure are in an interference fit to position and connect the outer jar and the inner cup.

6. The cosmetic jar having the replaceable inner cup according to claim 5, wherein the convex stepwise structure is a convex one-stage step structure on a surface of each of the two tabs;

the concave stepwise structure is a concave one-stage step structure on a surface of the outer circumferential sidewall of the outer jar; and a step surface of the convex one-stage step structure and a step surface of the concave one-stage step structure are in the interference fit.

7. The cosmetic jar having the replaceable inner cup according to claim 2, wherein the tab clamping portion comprises a tab through hole on each of the two tabs;

the outer jar clamping portion comprises an outer jar convex rib at each of the two accommodation regions on the outer circumferential sidewall of the outer jar; and by bending the two tabs downward, the outer jar convex rib is clamped in the tab through hole to position and connect the outer jar and the inner cup.

8. The cosmetic jar having the replaceable inner cup according to claim 7, wherein the outer jar convex rib comprises a columnar structure protruding from a surface of the outer circumferential sidewall of the outer jar;

an arc surface for sliding the columnar structure into the tab through hole conveniently is formed on a first side of an end portion of the columnar structure;

a second side of the end portion of the columnar structure is expanded to form a stop surface, wherein the second side of the end portion of the columnar structure is opposite to the arc surface, and the stop surface is configured to stop the columnar structure at the tab through hole; and the columnar structure of the outer jar convex rib is inserted into the tab through hole via the arc surface, and the columnar structure of the outer jar convex rib is stopped at the tab through hole by the stop surface.

9. The cosmetic jar having the replaceable inner cup according to claim 1, wherein an internal thread is provided on an inner circumferential sidewall of the lid and the internal thread is matched with and threadedly connected to the external thread of the outer jar; and a highest point of each of the two tabs and a highest point of the outer circumferential sidewall at each of the two accommodation regions of the outer jar do not exceed a highest point of the external thread on the outer jar.

* * * * *